US006382097B2

(12) United States Patent
Watanabe et al.

(10) Patent No.: US 6,382,097 B2
(45) Date of Patent: May 7, 2002

(54) STENCIL PRINTING MACHINE AND A WRINKLE PREVENTING METHOD ON A STENCIL SHEET OF THE STENCIL PRINTING MACHINE

(75) Inventors: Hiroshi Watanabe; Kenji Oshima; Hideyuki Kinoshita; Kenji Yoshida, all of Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/796,793

(22) Filed: Mar. 2, 2001

(30) Foreign Application Priority Data

Mar. 2, 2000 (JP) ..... 2000-057403

(51) Int. Cl.[7] ..... B41M 1/12
(52) U.S. Cl. ..... 101/129; 101/120
(58) Field of Search ..... 101/114, 116, 101/119, 120, 129, 425, 477

(56) References Cited

U.S. PATENT DOCUMENTS 5,913,265 A * 6/1999 Ishii et al. ..... 101/116
6,095,040 A * 8/2000 Ashikagaya et al. ..... 101/116
6,283,020 B1 * 9/2001 Ohno ..... 101/116
6,293,190 B1 * 9/2001 Yashima ..... 101/119
6,311,614 B1 * 11/2001 Ogata et al. ..... 101/116

FOREIGN PATENT DOCUMENTS

EP 0 653 307 A2 5/1995
EP 0 888 900 A1 1/1999

* cited by examiner

*Primary Examiner*—Ren Yan
(74) *Attorney, Agent, or Firm*—Sughrue Mion, PLLC

(57) ABSTRACT

An ink supplying roller (17) is disposed in a rotary cylindrical drum (16), and is moved so that the ink supplying roller (17) can be brought into contact with an inner peripheral surface of a cylindrical circumferential wall (15). The ink supplying roller (17) is placed at a contact position with an ink permeable portion **(15*a*) of the circumferential wall (15). The rotary cylindrical drum (16) is rotated in a state in which a stencil sheet (M) is not wound around the rotary cylindrical drum (16). Therefore, ink (50) drawn out through the ink permeable portion to the outer peripheral surface of the circumferential wall (15) because the stencil sheet (M) is peeled off at the stencil discharging operation is pulled into the ink permeable portion of the circumferential wall (15) by negative pressure produced by the ink supplying roller (17) coming in contact with the inner peripheral surface of the circumferential wall (15)** and is removed.

3 Claims, 11 Drawing Sheets

STENCIL PRINTING MACHINE AND A WRINKLE PREVENTING METHOD ON A STENCIL SHEET OF THE STENCIL PRINTING MACHINE

BACKGROUND OF THE INVENTION

1. Field of the Invention

The present invention relates to a stencil printing machine in which a stencil sheet already subjected to a stencil making process is wound around a rotary cylindrical drum for printing, and also relates to a wrinkle preventing method for a stencil sheet of the stencil printing machine.

The present application is based on Japanese Patent Application No. 2000-057403, which is incorporated herein by reference.

2. Description of the Related Art

Generally, a stencil printing machine includes a rotary cylindrical drum, which has an ink-permeable circumferential wall having a porous structure, and which can be rotated about its own axis. A stencil sheet, which has been subjected to a stencil making process, is wound around the outer peripheral surface of the circumferential wall. The rotary cylindrical drum contains an ink supplying device for supplying ink to the outer peripheral surface of the circumferential wall so as to allow the ink to pass through. Further, a press roller, that can come in contact with the outer peripheral surface of the circumferential wall, is placed outside of the rotary cylindrical drum. A printing sheet is supplied to a gap between the rotary cylindrical drum and the press roller in synchronization with rotation of the rotary cylindrical drum and the printing sheet is pressed by the press roller against the stencil sheet wound around the rotary cylindrical drum, whereby ink is passed through the perforated portions in the stencil sheet and is transferred to the printing sheet for printing.

When printing terminates and new printing is started, the used stencil sheet previously wound around the rotary cylindrical drum is peeled off and discharged and a newly-made stencil sheet is wound around the rotary cylindrical drum, whereby printing is performed in a similar manner to that described above.

However, with the stencil printing machine in the related art, when the used stencil sheet is discharged, the ink existing between the peeled-off stencil sheet and the outer peripheral surface of the circumferential wall is burst. As shown in FIG. 10A, ink 101 is drawn out onto the outer peripheral surface of a circumferential wall 100 of a rotary cylindrical drum so that the ink 101 is napped from holes 100*a* in the circumferential wall 100 by peeling off a stencil sheet M. Accordingly, the ink 101 is put sparsely on the outer peripheral surface of the circumferential wall 100.

In the state shown in FIG. 10A, if a newly-made stencil sheet M is wound around the circumferential wall 100, spaces S occur between the outer peripheral surface of the circumferential wall 100 and the stencil sheet M, as shown in FIG. 10B. At the printing, the spaces S become air layers S', causing the attached stencil sheet M to be wrinkled so that an image appearing on a printing sheet is influenced.

FIGS. 11A to 11D show a process (print process) in which the circumferential wall 100 onto which the stencil sheet M is attached is developed into a plane in the state in which the spaces S (air layers S') occur as mentioned above and a press roller 12 presses with rotation of the rotary cylindrical drum.

As shown in FIGS. 11A and 11B, when the press roller 102 presses along the move direction of the circumferential wall 100 as the rotary cylindrical drum is rotated, the air layers S' are built up to a mass, which is carried away downstream of the stencil sheet M. As shown in FIGS. 11C and 11D, the air layer S' mass is discharged from a part of the downstream end of the stencil sheet M. Thus, the portion not uniformly carried away by the press roller 102, namely, the portion of the stencil sheet M swollen by the air layer S' mass is crushed and broken by the press roller 102 to produce wrinkles 103.

The air layers S' easily occur particularly if there is used a low-rigidity stencil sheet easy to break or a stencil sheet made at a high closed density based on an original of a low perforation rate.

SUMMARY OF THE INVENTION

It is therefore an object of the present invention to provide a stencil printing machine for making it possible to eliminate air layers occurring between an attached stencil sheet and a circumferential wall for preventing the stencil sheet from being wrinkled, and a wrinkle preventing method on a stencil sheet of the stencil printing machine.

To achieve the above object, according to a first aspect of the present invention, there is provided a stencil printing machine which comprises a rotary cylindrical drum rotatable about its own axis, the rotary cylindrical drum including an ink-permeable cylindrical circumferential wall having an outer peripheral surface around which a stencil sheet subjected to a stencil making process can be wound; a contact member capable of contacting with an inner peripheral surface of the circumferential wall, the contact member being disposed in the rotary cylindrical drum; and a move mechanism capable of moving the contract member to a contact position at which the contact member is brought into contact with the inner peripheral surface of the circumferential wall or a distance position at which the contact member is spaced with a predetermined interval from the inner peripheral surface of the circumferential wall, wherein when the stencil sheet is not wound around the circumferential wall of the rotary cylindrical drum, the rotary cylindrical drum is rotated while the contact member is placed at the contact position relative to an ink permeable portion of the circumferential wall.

As described above, the stencil printing machine according to the present invention includes the contact member that can be moved to the contact position with or the distance position from the inner peripheral surface of the circumferential wall in the rotary cylindrical drum. The contact member is placed at the contact position with the ink permeable portion of the circumferential wall and the rotary cylindrical drum is rotated in a state in which the stencil sheet is not wound around the rotary cylindrical drum, whereby ink drawn out through the ink permeable portion of the circumferential wall to the outer peripheral surface thereof because of peeling off the stencil sheet in the stencil discharging operation is pulled into the ink permeable portion of the circumferential wall by negative pressure produced by the contact member coming in contact with the inner peripheral surface of the circumferential wall and is removed. Therefore, if a newly-made stencil sheet is attached onto the outer peripheral surface of the circumferential wall, air layers are not produced between the outer peripheral surface of the circumferential wall and the stencil sheet. Thus, in a printing operation, the stencil sheet attached onto the rotary cylindrical drum can be prevented from being wrinkled, and a desired print image can be printed on a printing sheet without any wrinkles.

According to a second aspect of the present invention, the contact member may include an ink supplying roller which supplies ink to the inner peripheral surface of the circumferential wall.

In the stencil printing machine as recited in the second aspect of the present invention, the contact member is implemented as an ink supplying roller for supplying ink to the inner peripheral surface of the circumferential wall, so that the stencil sheet can be prevented from being wrinkled using the already existing configuration of stencil printing machine.

Of course, according to a third aspect of the present invention, to achieve the above object, there may be provided a wrinkle preventing method for preventing a wrinkle on a stencil sheet. In this case, the method may comprise the step of providing a stencil printing machine which includes a rotary cylindrical drum rotatable about its own axis, the rotary cylindrical drum including an ink-permeable cylindrical circumferential wall having an outer peripheral surface around which a stencil sheet subjected to a stencil making process can be wound; a contact member capable of contacting with an inner peripheral surface of the circumferential wall, the contact member being disposed in the rotary cylindrical drum; and a move mechanism capable of moving the contract member to a contact position at which the contact member is brought into contact with the inner peripheral surface of the circumferential wall or a distance position at which the contact member is spaced with a predetermined interval from the inner peripheral surface of the circumferential wall, and further comprise the steps of discharging the stencil sheet from the rotary cylindrical drum so that the rotary cylindrical drum is placed in a state in which the stencil sheet is not wound around the circumferential wall of the rotary cylindrical drum; rotating the rotary cylindrical drum while placing the contact member at the contact position relative to an ink permeable portion of the circumferential wall; placing the contact member at the distance position relative to the ink permeable portion of the circumferential wall; and winding, around the outer peripheral surface of the circumferential wall of the rotary cylindrical drum, a stencil sheet subjected to the stencil making process.

Accordingly, in the process from the stencil discharging operation to the stencil attaching operation, ink drawn out through the ink permeable portion of the circumferential wall to the outer peripheral surface thereof can be removed and the stencil sheet can be prevented from being wrinkled. Particularly, the contact member is placed at the contact position with the ink-permeable of the circumferential wall while the stencil sheet is peeled off at the stencil discharging operation and subsequently at the stencil attaching operation, the contact member is placed at the contact position with the ink-permeable of the circumferential wall while the stencil sheet is attached onto the rotary cylindrical drum, whereby ink drawn out through the ink permeable portion of the circumferential wall to the outer peripheral surface thereof can be removed during the process of the stencil attaching operation from the stencil discharge operation.

DETAILED DESCRIPTION OF THE PREFERRED EMBODIMENT

Figure 1:
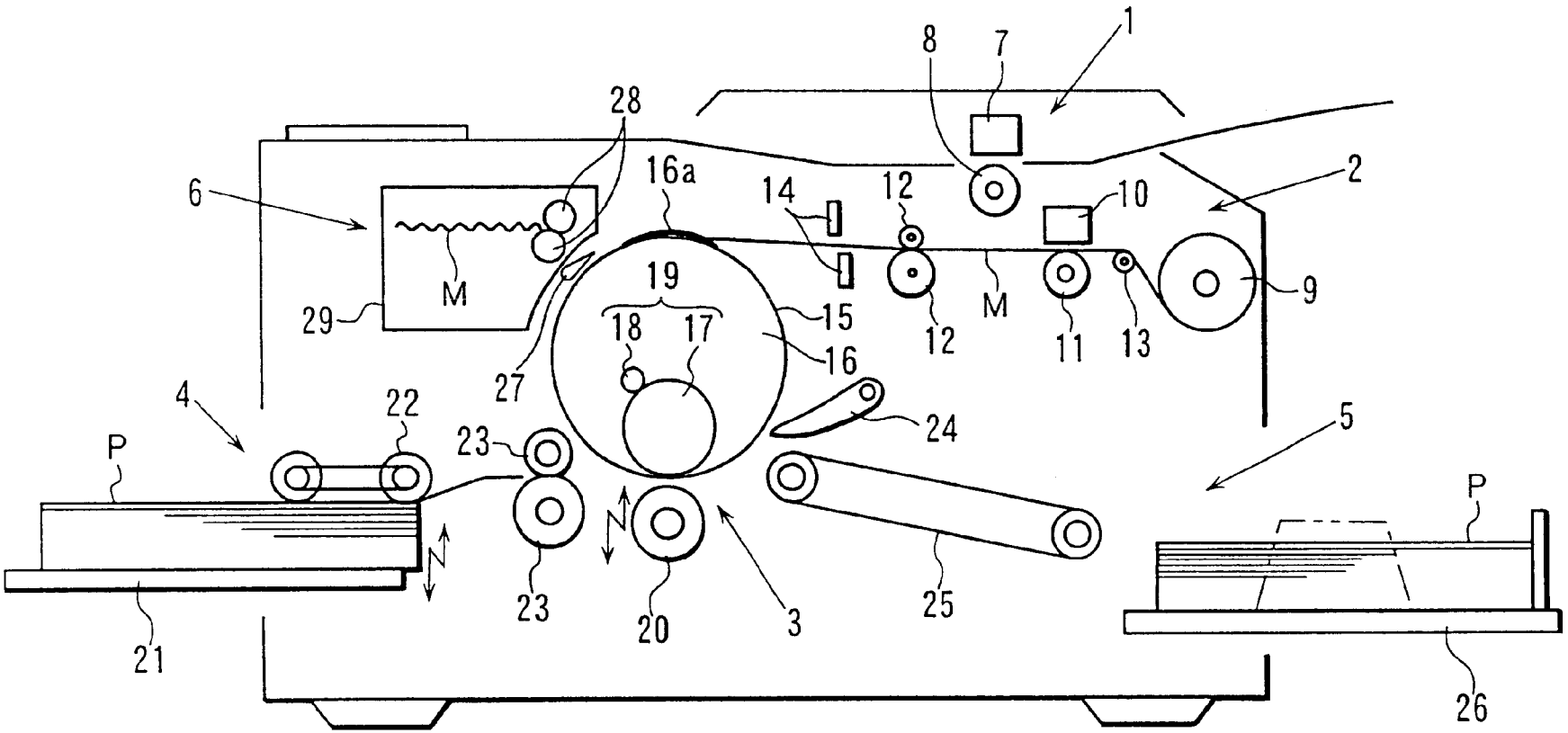
FIG. 1 is a side view showing one example of a stencil printing machine according to the present invention.

A preferred embodiment of the present invention now will be described with reference to the accompanying drawings.

The stencil printing machine includes an original reading section 1, a stencil making section 2, a printing section 3, a sheet supplying section 4, a sheet discharging section 5, and a stencil discharging section 6.

The original reading section 1 serves as an image scanner, and includes a line image sensor 7 for effecting the reading of an image on an original which is transported in a subscanning direction, and an original feeding roller 8. It should be noted that the original reading section 1 is not limited to the above-described configuration, and the image on the original may be read by moving the line image sensor 7 in the subscanning direction with respect to a fixed original. Namely, the original reading section 1 reads the image on the original by relatively moving the original and the line image sensor 7.

The stencil making section 2 includes a stencil roll portion 9, a thermal head 10 arranged in a horizontal row and formed of a plurality of dot-like heating elements, a platen roller 11, a stencil feeding roller 12, a stencil guide roller 13, and a stencil cutter 14. As the platen roller 11 rotates, a stencil sheet M is continuously drawn out from the stencil roll portion 9, and is transported between the thermal head 10 and the platen roller 11. Image data of the original which has been read by the aforementioned original reading section 1 is input to the thermal head 10. The plurality of dot-like heating elements of the thermal head 10 are individually and selectively heated, so that the thermographic stencil sheet M is subjected to a thermographic stencil-making process, to thereby form a desired perforated image formed of a plurality of fine through holes in the stencil sheet M in a dot-matrix manner. During this stencil making process, as for the stencil sheet M drawn out from the stencil roll portion 9 by the platen roller 11, a desired tensile force is applied thereto by the stencil guide roller 13 to prevent the occurrence of wrinkles and the like. In addition, the stencil sheet M, which has undergone the stencil making process, is further transported by the stencil feeding roller 12, and one stencil portion is cut by the stencil cutter 14.

The printing section 3 includes a rotary cylindrical drum 16 having a ink-permeable cylindrical circumferential wall 15 having a porous structure formed of an ink-permeable material such as a porous metal plate, a mesh structure, or the like. The rotary cylindrical drum 16 is rotated counterclockwise in FIG. 1 about its own axis by a drive device (not shown). It is formed on an outer periphery with a clamping portion 16*a* for clamping the tip of the stencil sheet M. The rotary cylindrical drum 16 is rotated while clamping the tip of the transported, already made stencil sheet M by the clamping portion 16*a*, whereby the stencil sheet M is wound around the outer peripheral surface of the rotary cylindrical drum 16. The rotary cylindrical drum 16 includes an ink supplying unit 19 comprised of an ink supplying roller 17 and a doctor roller 18. Further, a press roller 20 is placed movably outside the rotary cylindrical drum 16 so that it can be brought into and out of contact with the outer peripheral surface of the rotary cylindrical drum 16 (circumferential wall 15).

The sheet supplying section 4 is placed at one side of the printing section 3. It includes a sheet supplying tray 21 on which sheets of a printing sheet P are piled up, pickup rollers 22 for taking out the printing sheet P one sheet at a time from the sheet supplying tray 21, and sheet supplying-timing rollers 23 for feeding the printing sheet P into the gap between the rotary cylindrical drum 16 and the press roller 20.

The sheet discharging section 5 is placed at an opposite side of the printing section 3. It includes a separating claw 24 for stripping off the printing sheet P from the rotary cylindrical drum 16, a discharged-sheet feeding-belt section 25 for transporting the stripped printing sheet P, and a sheet discharging tray 26 on which sheets of the printing sheet P already printed are piled up.

The stencil discharging section 6 is placed at one side of the printing section 3. It includes a peeling-off claw 27 for peeling off an already used stencil sheet M from the rotary cylindrical drum 16, a stencil discharging rollers 28 for transporting the peeled-off stencil sheet M, and a stencil discharging box 29 for storing the transported stencil sheet M.

In the described stencil printing machine, predetermined ink is supplied to the inner peripheral surface of the circumferential wall 15 of the rotary cylindrical drum 16 by the ink supplying unit 19. The rotary cylindrical drum 16 is rotated counterclockwise in FIG. 1 about its own axis. The printing sheet P is moved from left to right in FIG. 1 by the sheet supplying-timing rollers 23 at a predetermined timing in synchronization with the rotation of the rotary cylindrical drum 16 and is supplied to the gap between the rotary cylindrical drum 16 and the press roller 20. Since the press roller 20 is moved, the printing sheet P is pressed against the stencil sheet M wound around the outer peripheral surface of the rotary cylindrical drum 16 (circumferential wall 15), whereby ink passing through the stencil sheet M from the rotary cylindrical drum 16 is transferred to the printing sheet P for performing stencil printing.

Figure 2:
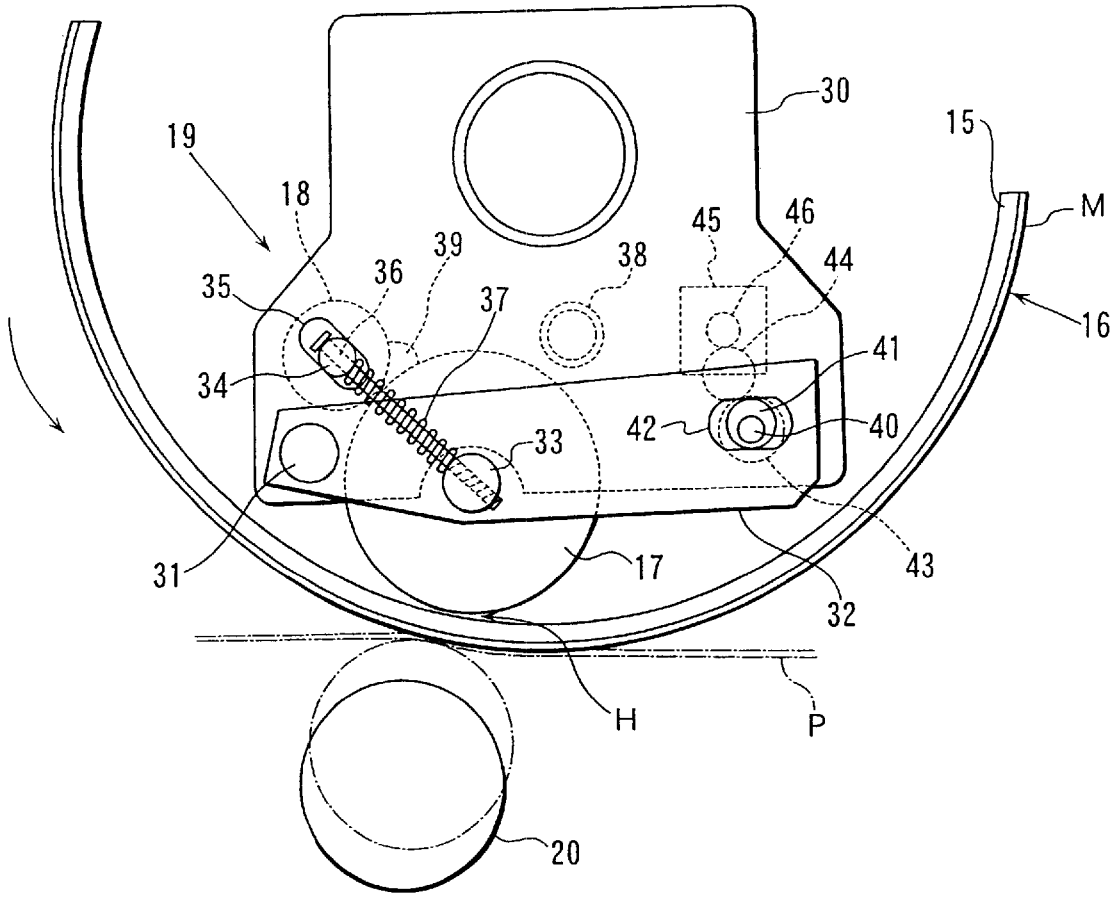
FIG. 2 is a side view showing one example of an ink supplying unit of the stencil printing machine shown in FIG. 1.
Figure 3:
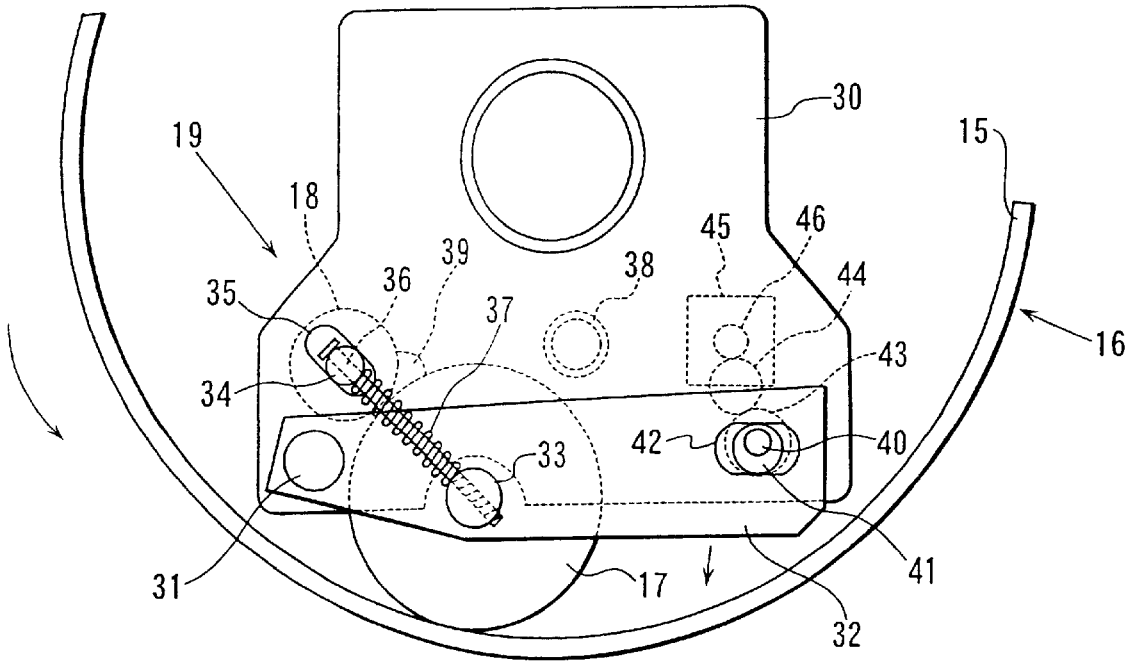
FIG. 3 shows the operation of the ink supplying unit shown in FIG. 2.

FIG. 2 is a side view showing one example of the ink supplying unit and FIG. 3 is a drawing showing the operation of the ink supplying unit.

Side plates 30 are respectively fixed to both end parts of the ink supplying roller 17 in the rotary cylindrical drum 16. One end part of a support lever 32 is journaled to each side plate 30 by a pivot 31. A support shaft 33 for enabling the ink supplying roller 17 to be rotated is supported at an intermediate point of each support lever 32. The doctor roller 18 is supported on each side plate 30. The doctor roller 18 has protrusions 34 at both end parts and the protrusions 34 are engaged into slits 35 formed in the side plates.

A stay rod 36 is passed through the protrusion 34 of the doctor roller 18. The stay rod 36 is formed at one end part with a male thread and is screwed to the support shaft 33 of the ink supplying roller 17. In the stay rod 36, a helical compression spring 37 is wound between the protrusion 34 and the support shaft 33, whereby the ink supplying roller 17 and the doctor roller 18 form a mutual interval by the stay rod 36 and the mutual interval is maintained by the helical compression spring 37. The screwing amount of the stay rod 36 into the support shaft 33 is adjusted, whereby the interval between the ink supplying roller 17 and the doctor roller 18 is adjusted. The ink supplying roller 17 is joined by the stay rod 36 to the doctor roller 18 supported on the side plates 30, whereby it is supported on the side plates 30 via the support lever 32.

An ink supply part 38 for supplying ink to the outer peripheral surface of the ink supplying roller 17 is placed above the ink supplying roller 17.

Normally, the ink supplying roller 17 is set at a distance position from the rotary cylindrical drum 16 so that the outer peripheral surface of the ink supplying roller 17 is spaced with a predetermined interval H (about 0.3 mm) from the inner peripheral surface of the circumferential wall 15 of the rotary cylindrical drum 16, as shown in FIG. 2. At the printing, the moved press roller 20 presses the printing sheet P and the stencil sheet M wound around the outer peripheral surface of the circumferential wall 15, whereby the ink supplying roller 17 receives the press force and is brought into contact with the inner peripheral surface of the circumferential wall 15, so that the ink supplying roller 17 presses the stencil sheet M and the printing sheet P with the press roller 20.

When the ink supplying roller 17 is brought into contact with the inner peripheral surface of the circumferential wall 15, it is rotated counterclockwise in FIG. 2 on the support shaft 33 in synchronization with rotation of the rotary cylindrical drum 16. Since the ink supplying roller 17 is rotated, ink supplied to the outer peripheral surface of the ink supplying roller 17 by the ink supply part 38 is moved to the doctor roller 18, forming a wedge-shaped ink reservoir 39 in a gap between the ink supplying roller 17 and the doctor roller 18. When the ink supplying roller 17 is furthermore rotated, the ink in the ink reservoir 39 passes through the gap between the ink supplying roller 17 and the doctor roller 18 and is deposited on the outer peripheral surface of the ink supplying roller 17 like a layer with a thickness determined by the size of the gap. The ink thus deposited on the outer peripheral surface of the ink supplying roller 17 is supplied to the inner peripheral surface of the circumferential wall 15. That is, the gap between the ink supplying roller 17 and the doctor roller 18 is a gap for determining the amount of ink supplied to the inner peripheral surface of the circumferential wall 15, and the gap is adjusted as mentioned above, whereby the ink amount can be adjusted.

In the ink supplying unit, the ink supplying roller 17 can be moved by a move mechanism from the above-mentioned distance position to a contact position at which it comes in contact with the inner peripheral surface of the circumferential wall 15. The move mechanism will be discussed.

As shown in FIG. 2, a pivot 40 is placed between the side plates 30 for rotation. A cam 41 is fixed to the pivot 40. The cam 41 is engaged into a slit 42 formed at an opposite end part of the support lever 32 for supporting the ink supplying roller 17. A driven gear 43 is also fixed to the pivot 40. The driven gear 43 is meshed with a drive gear 46 fixed to the output shaft of a drive motor 45 via a speed reducing gear 44. If the drive motor 45 is driven, the driven gear 43 rotates the pivot 40, rotating the cam 41. Thus, the opposite end part of the support lever 32 is swung downward as shown in FIG. 3, and the ink supplying roller 17 is moved to the contact position at which it comes in contact with the inner peripheral surface of the circumferential wall 15. Thus, the ink supplying roller 17 serves as a contract member that can be moved to the contact position at which it comes in contact with the inner peripheral surface of the circumferential wall 15 or the distance position at which the ink supplying roller 17 is spaced with the predetermined interval H from the inner peripheral surface of the circumferential wall 15.

The stencil discharging operation and the stencil attaching operation of the described stencil printing machine will be discussed.

Figure 4:
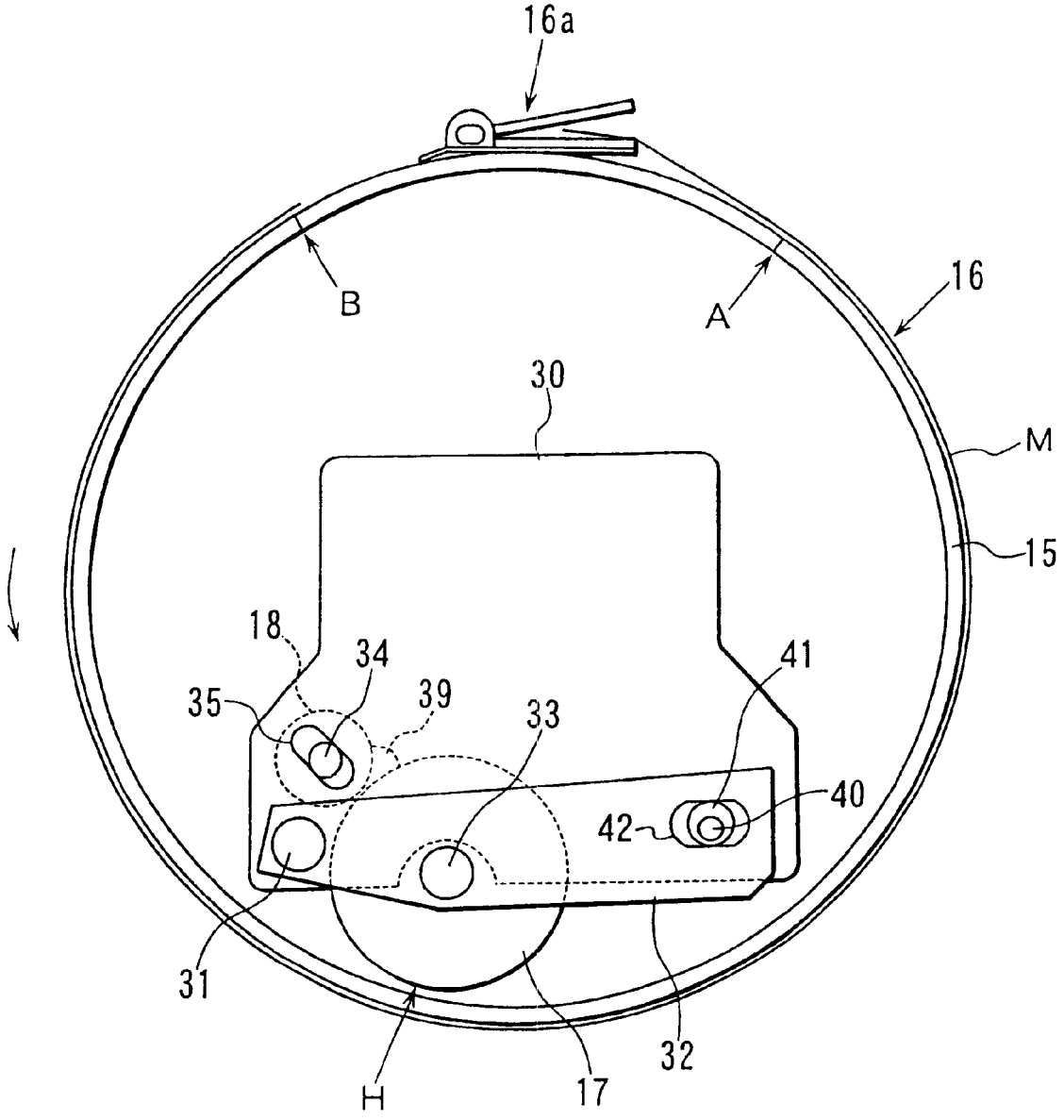
FIG. 4 shows the stencil discharging operation.
Figure 5:
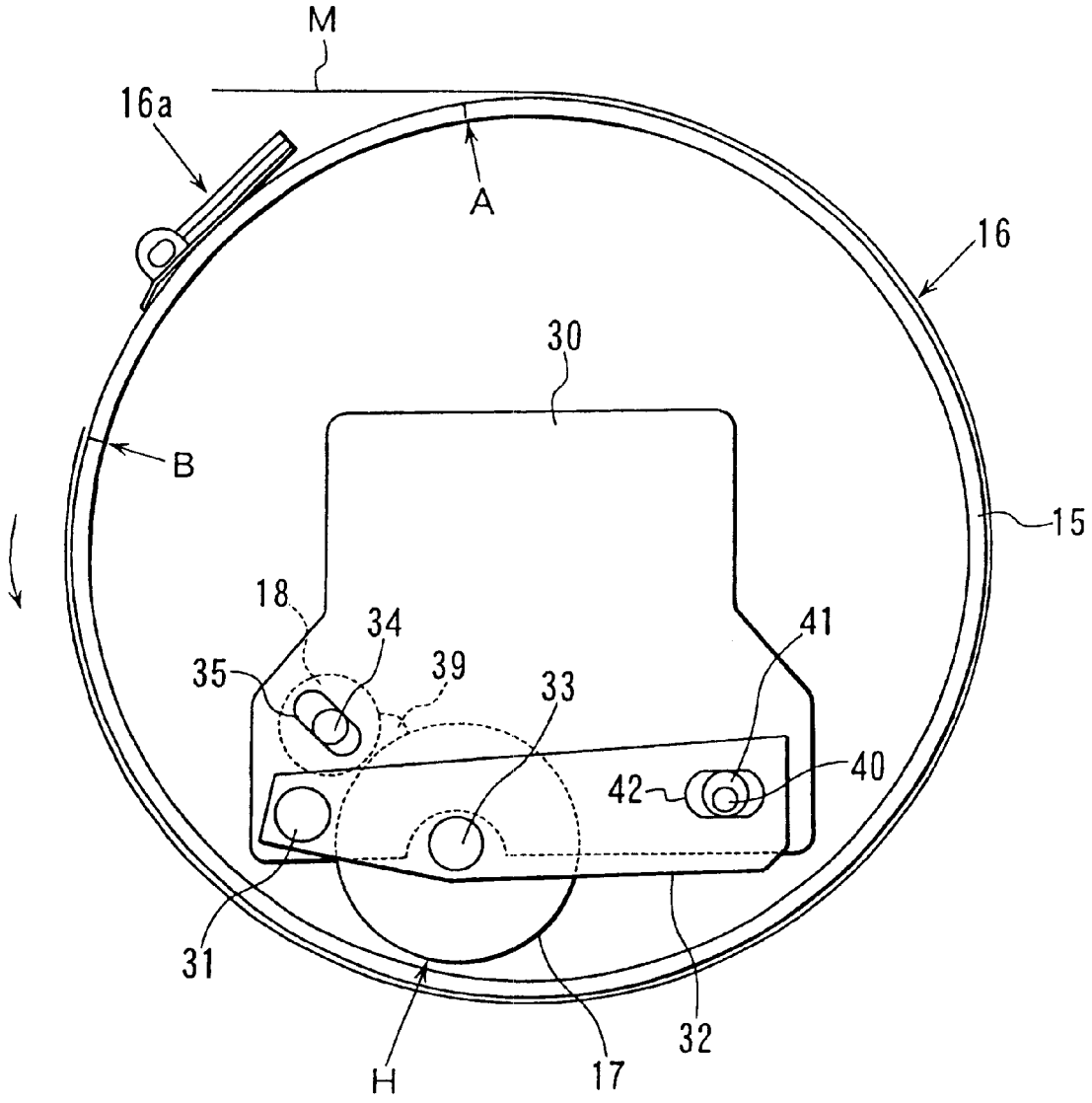
FIG. 5 shows the stencil discharging operation.
Figure 6:
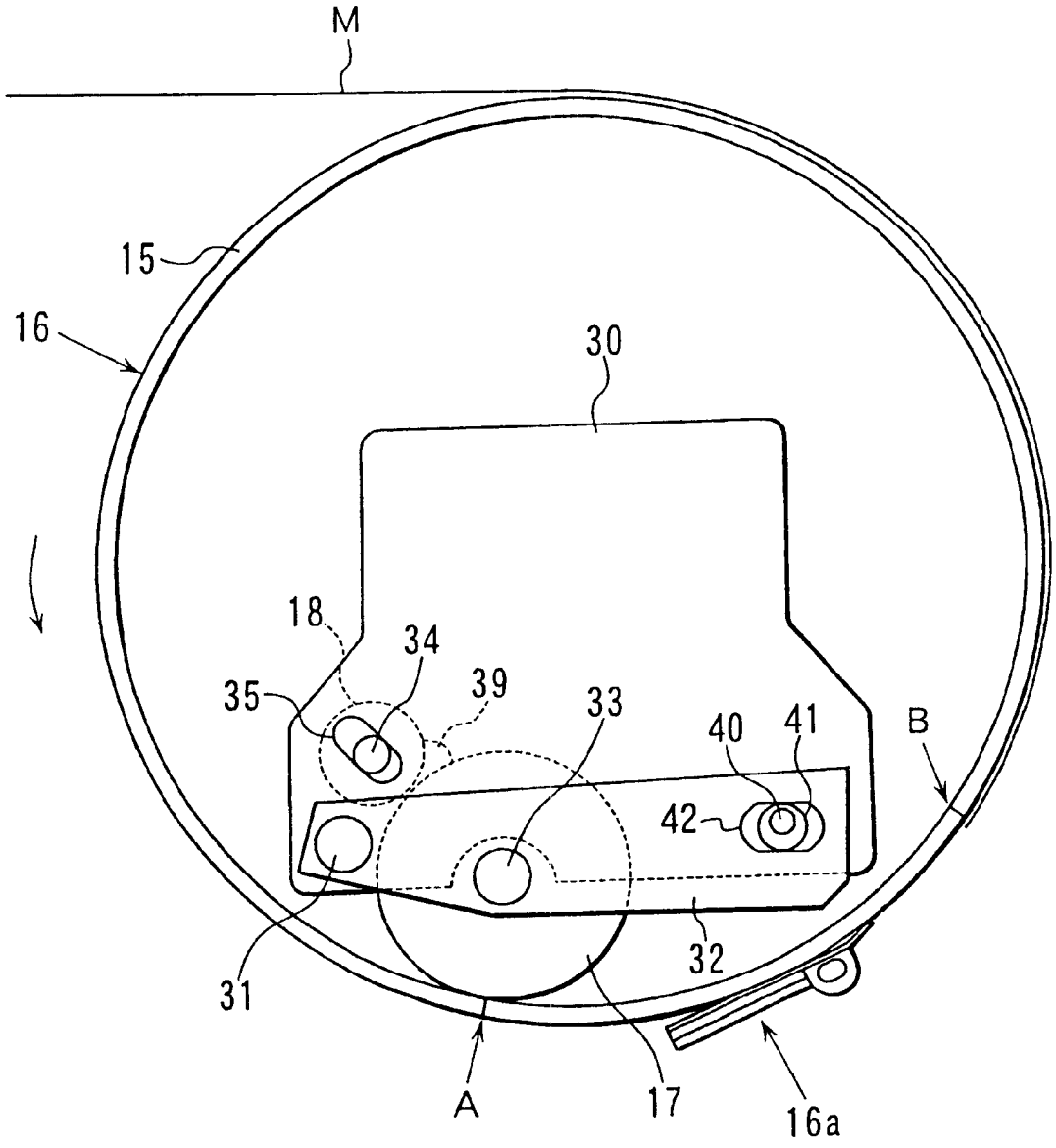
FIG. 6 shows the stencil discharging operation.
Figure 7:
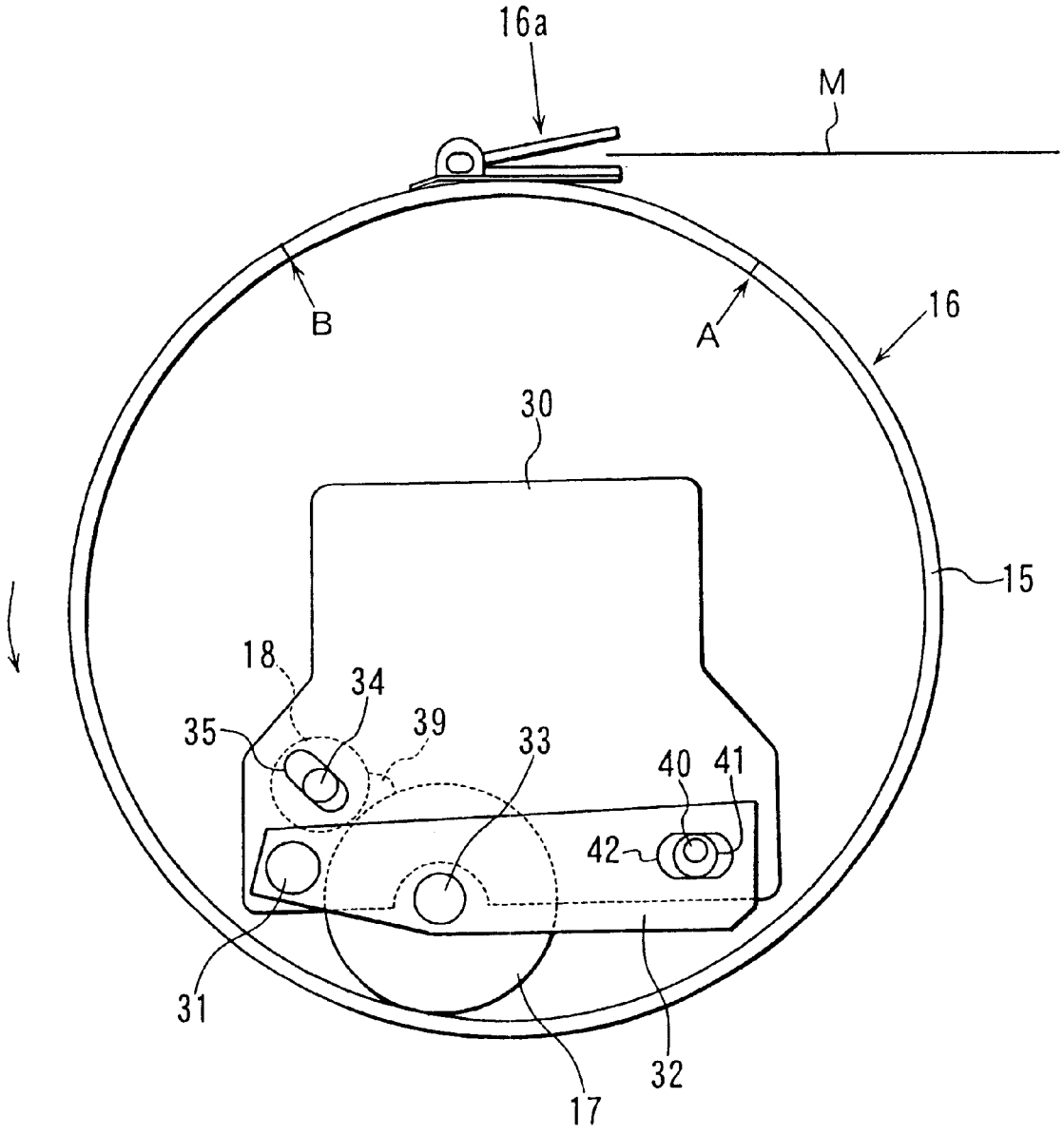
FIG. 7 shows the stencil attaching operation.
Figure 8:
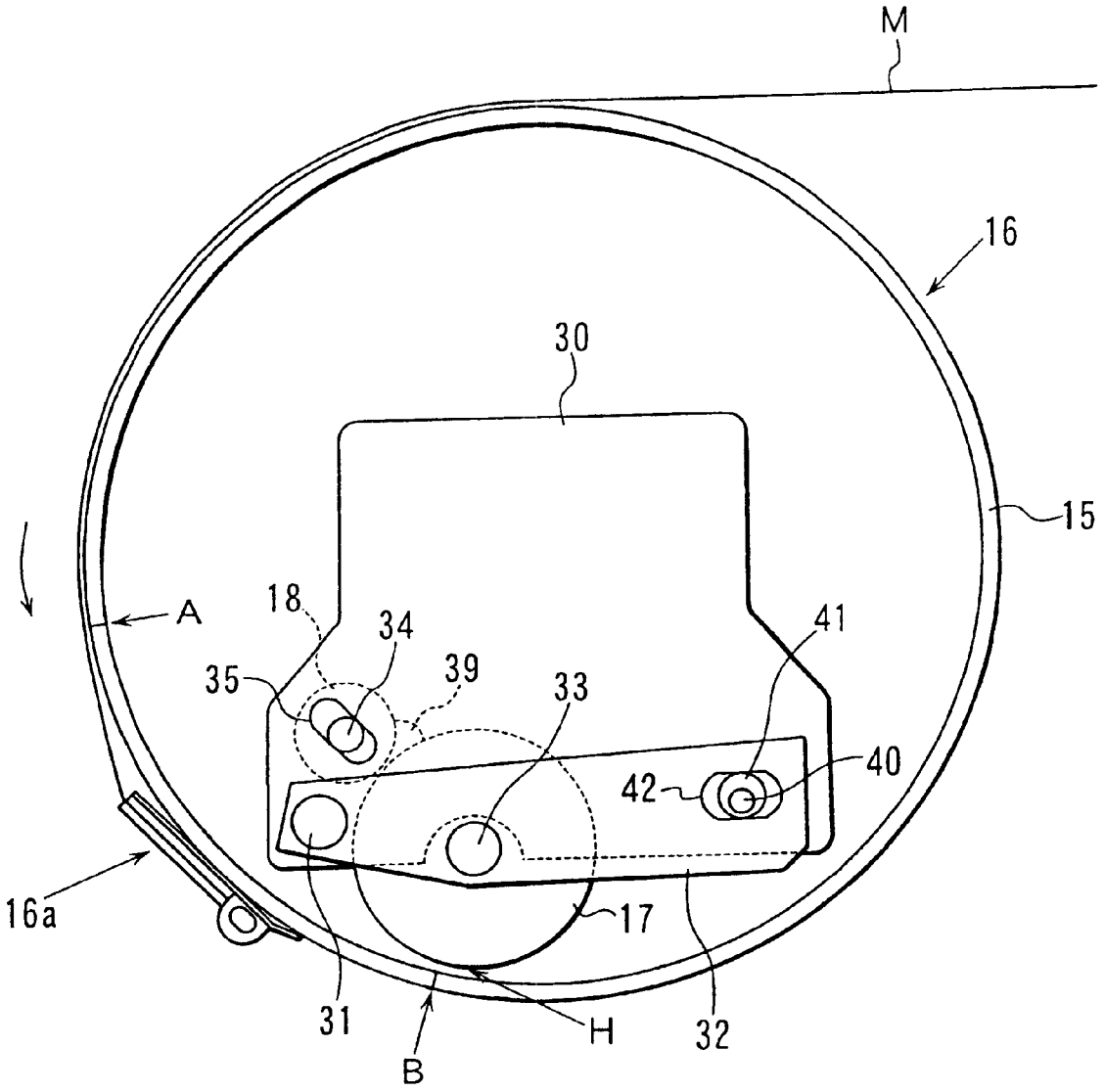
FIG. 8 shows the stencil attaching operation.

FIGS. 4 to 6 are drawings showing the stencil discharging operation and FIGS. 7 and 8 are drawings showing the stencil attaching operation.

In FIGS. 4 to 8, the part of the circumferential wall 15 indicated by symbol A is the start end of an ink permeable portion for allowing ink to pass through at rotation of the rotary cylindrical drum 16 and the part indicated by symbol B is the termination of the ink permeable portion. The ink permeable portion is the range in which the clamping portion 16*a* does not intervene from the start end A to the termination B. The range in which the clamping portion 16*a* intervenes from the start end A to the termination B is an ink non-permeable portion for not allowing ink to pass through.

At the stencil discharging operation, as shown in FIG. 4, the clamping portion 16*a* placed on the rotary cylindrical drum 16 is opened by a drive mechanism (not shown), releasing clamping of the tip of the stencil sheet M. As shown in FIG. 5, the released tip of the stencil sheet M is peeled off by the peeling-off claw 27 of the stencil discharging section 6 because the rotary cylindrical drum 16 is rotated counterclockwise in FIG. 5, and is transported to the stencil discharging box 29 by the stencil discharging rollers 28.

In the state shown in FIGS. 4 and 5, the ink supplying roller 17 is placed at the distance position (at the normal time) at which it is spaced with the predetermined interval H (about 0.3 mm) from the inner peripheral surface of the circumferential wall 15.

Then, as shown in FIG. 6, when the start end A is about to come to one position of the ink supplying roller 17 because the rotary cylindrical drum 16 is rotated, the drive motor 45 is driven and the cam 41 is rotated, whereby the ink supplying roller 17 is moved to the contact position at which it comes in contact with the inner peripheral surface of the circumferential wall 15. When the rotary cylindrical drum 16 makes one revolution, the stencil sheet M is peeled off from the rotary cylindrical drum 16 and is entirely stored in the stencil discharging box 29. When the stencil sheet M is discharged, a newly-made stencil sheet M is attached onto the rotary cylindrical drum 16.

At the stencil attaching operation, the clamping portion 16*a* placed on the rotary cylindrical drum 16 is opened by the drive mechanism (not shown), releasing clamping of the tip of the stencil sheet M. The tip of the stencil sheet M transported from the stencil making section 2 is clamped by the clamping portion 16*a*. When the rotary cylindrical drum 16 is rotated counterclockwise in FIG. 7, attaching the stencil sheet M on the outer peripheral surface of the circumferential wall 15 is started. At this time, the ink supplying roller 17 remains placed at the contact position at the stencil discharging operation.

Subsequently, as shown in FIG. 8, when the termination B is about to come to one position of the ink supplying roller 17, the drive motor 45 is driven and the cam 41 is rotated, whereby the ink supplying roller 17 is moved to the distance position at which it is spaced with the predetermined interval H from the inner peripheral surface of the circumferential wall 15. When the rotary cylindrical drum 16 makes one revolution, the stencil sheet M is attached onto the outer peripheral surface of the circumferential wall 15 of the rotary cylindrical drum 16 as much as one stencil.

Thus, in the process from the stencil discharging operation to the stencil attaching operation, the ink supplying roller 17 is placed at the contact position at which it comes in contact with the inner peripheral surface of the circumferential wall 15 in the state in which the stencil sheet M before being attached onto the rotary cylindrical drum 16 does not exist on the outer peripheral surface of the circumferential wall 15 in the ink permeable portion from the start end A to the termination B.

The position when the start end A or the termination B is about to come to one position of the ink supplying roller 17 because the rotary cylindrical drum 16 is rotated can be detected based on the rotation angle of the rotary cylindrical drum 16 or with various sensors, etc., and the move mechanism may be controlled because the position is detected.

Figure 9B:
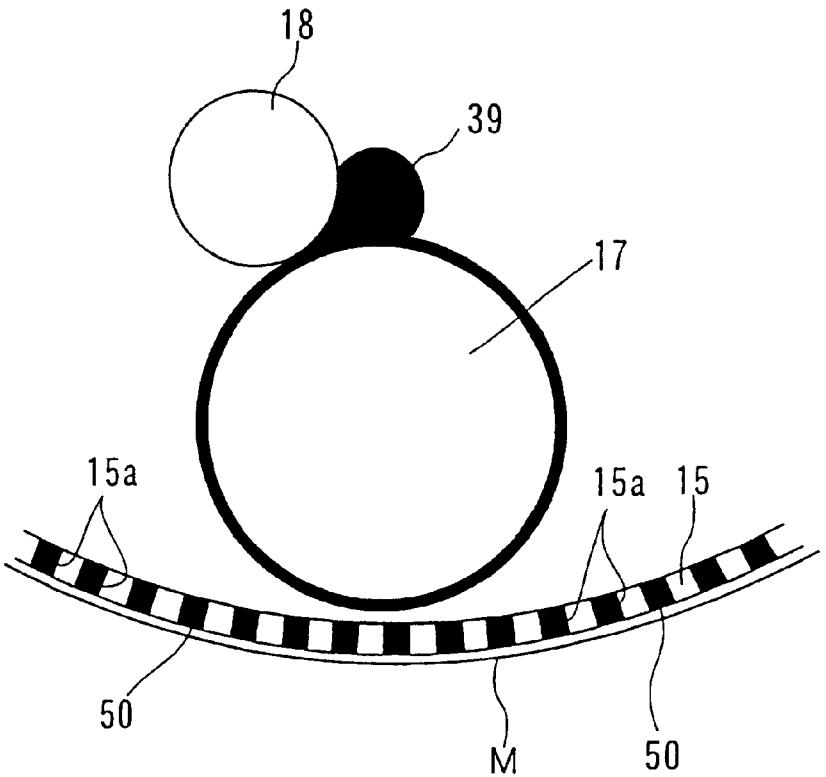
FIG. 9B is a side view showing a state in which the stencil sheet is attached onto a circumferential wall in FIG. 9A.
Figure 9A:
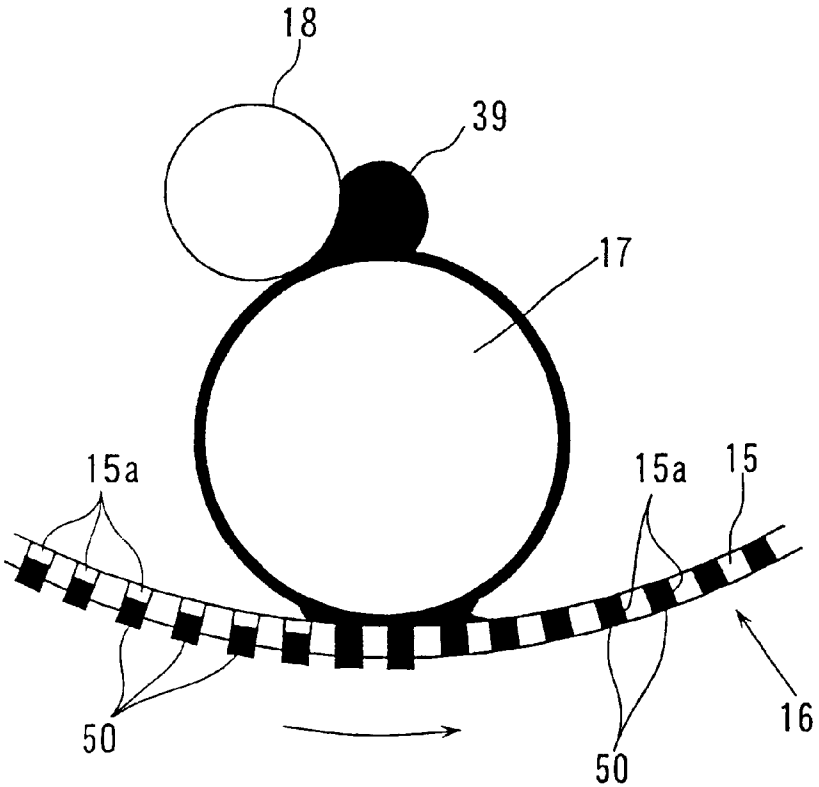
FIG. 9A is a side view showing an ink removal function.
Figure 10B:
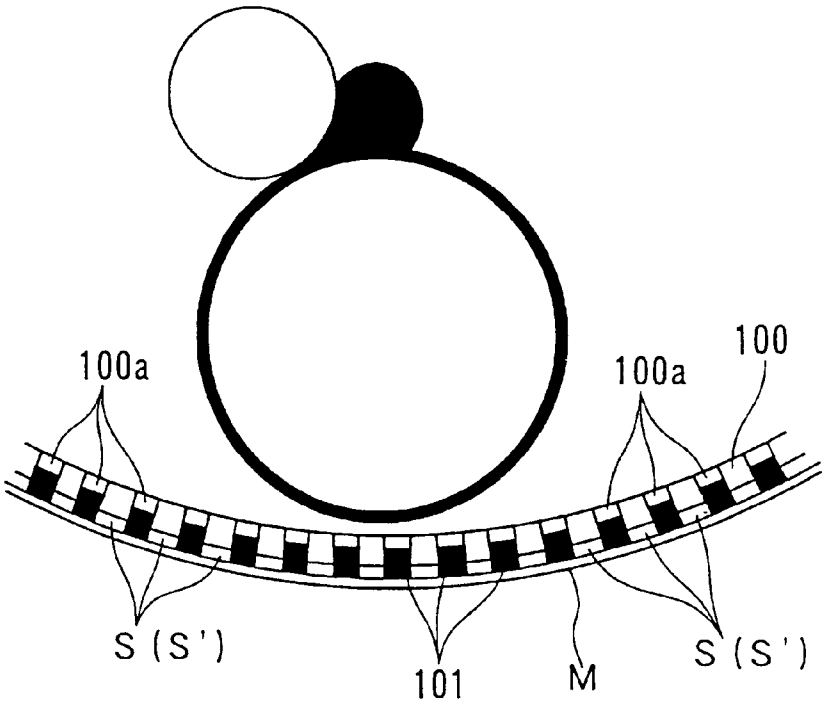
FIG. 10B is a side view showing a state in which the stencil sheet is attached onto the circumferential wall in FIG. 10A.
Figure 10A:
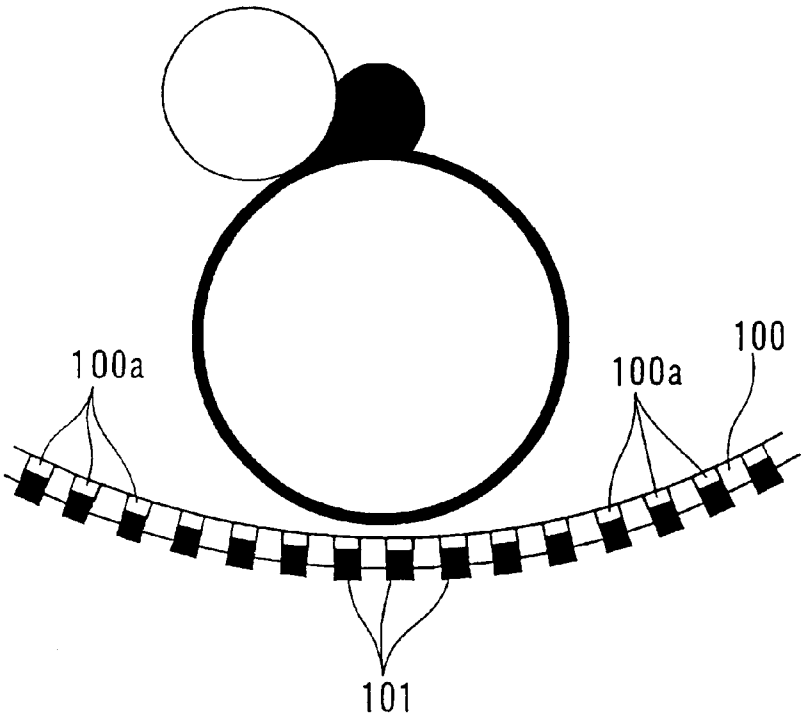
FIG. 10A is a side view showing the state of the outer peripheral surface of a circumferential wall after the stencil sheet is discharged in a related art.
Figures 11A, 11B, 11C, 11D:
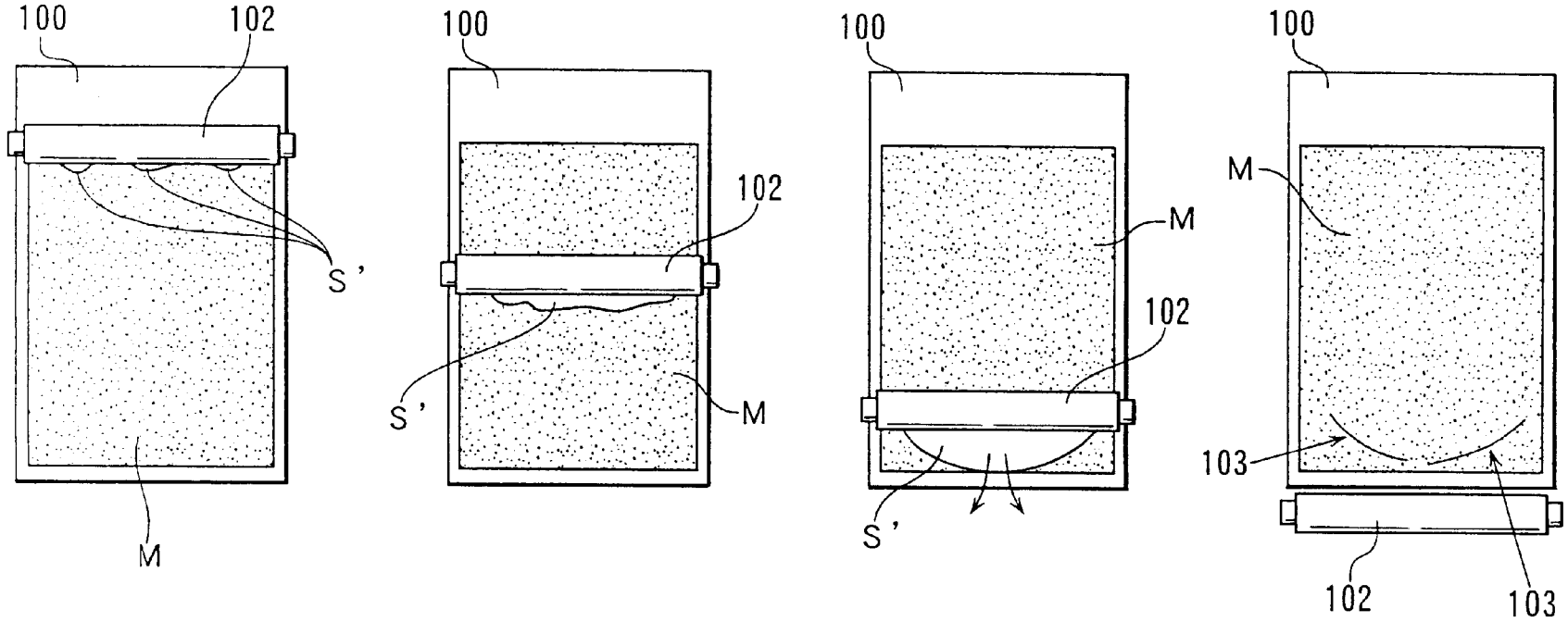
FIGS. 11A to 11D are conceptual drawings showing a process in which the stencil sheet is wrinkled in the related art.

Then, as shown in FIG. 9A, ink 50 drawn out through holes 15*a* in the circumferential wall 15 to the outer peripheral surface thereof because the stencil sheet M is peeled off at the stencil discharging operation is pulled into the holes 15*a* in the circumferential wall 15 by negative pressure produced by the ink supplying roller 17 coming in contact with the inner peripheral surface of the circumferential wall 15 and is removed. As shown in FIG. 9B, if the stencil sheet M is attached onto the outer peripheral surface of the circumferential wall 15, spaces leading to air layers do not occur between the outer peripheral surface of the circumferential wall 15 and the stencil sheet M. Therefore, at the printing, the stencil sheet M attached onto the rotary cylindrical drum 16 is not wrinkled, and it is made possible to print any desired print image on a printing sheet P.

In the related art, wrinkles easily occur if a low-rigidity stencil sheet M easy to break or a stencil sheet M made at a high closed density with an original at a low perforation rate is used. However, according to the described configuration, wrinkles would not be generated even with the stencil sheet M as described above. Particularly, as the low-rigidity stencil sheet M easy to break, a thermoplastic resin film is made thin for the purpose of improving sensitivity so that a stencil making operation can be accomplished even with low energy at a time when a thermographic perforating operation is executed in the thermographic stencil-making process. In the present invention, a stencil sheet M which is low in rigidity can be used without a problem, so that energy suppressing at the stencil making process can be promoted.

In the described embodiment, in the process from the stencil discharging operation to the stencil attaching operation, the ink supplying roller 17 is brought into contact with the inner peripheral surface of the circumferential wall 15 in the state in which the stencil sheet M does not exist on the outer peripheral surface of the circumferential wall 15 before the stencil sheet M is completely discharged while the rotary cylindrical drum 16 is rotated at the stencil discharging operation and before the stencil sheet M is completely attached onto the rotary cylindrical drum 16 while the rotary cylindrical drum 16 is rotated at the stencil attaching operation. Therefore, the ink supplying roller 17 is moved and the stencil sheet M is prevented from being wrinkled in the process from the stencil attaching operation to the stencil discharging operation, so that the rotary cylindrical drum 16 need not be newly rotated and the first print time from the user pressing a start button on an operation panel to execution of a stencil making process, a stencil discharging operation, a stencil attaching operation, and a printing operation on a first (i.e., initial) printing sheet to discharging of the first printing sheet is not prolonged. However, the ink supplying roller 17 may be moved and the rotary cylindrical drum 16 may be newly rotated after the stencil sheet M is completely peeled off from the circumferential wall 15 and the stencil discharging operation is completed depending on the situation.

In the description of the embodiment, the drive motor 45 is adopted as the drive source for rotating the driven gear 43 of the pivot 40 as the move mechanism for moving the ink supplying roller 17 to the distance position and the contact position, but the present invention is not limited to the example. As another example, the driven gear 43 may be driven through a clutch mechanism by rotating the rotary cylindrical drum 16. That is, the clutch mechanism is operated as required and the ink supplying roller 17 is moved to the distance position and the contact position with rotation of the rotary cylindrical drum 16.

In the description of the embodiment, the configuration wherein the press roller 20 is placed outside the rotary cylindrical drum 16 and is moved so as to come in contact with the outer peripheral surface of the circumferential wall 15 for printing is adopted as an example of the stencil printing machine, but the present invention is not limited to the example. As another example, although not shown, the following configuration is available: A sheet drum, around which a printing sheet P is wound, is placed outside the rotary cylindrical drum 16, and the ink supplying roller 17 serving as an inside push roller is moved so as to swell the circumferential wall 15, thereby bringing the outer peripheral surface of the circumferential wall 15 into contact with the printing sheet P wound around the sheet drum for printing. In the configuration wherein the circumferential wall 15 is swollen by the ink supplying roller 17 serving as the inside push roller, the inside push roller (ink supplying roller 17) is moved in a state in which the stencil sheet M does not exist on the outer peripheral surface of the circumferential wall 15 in the process from the stencil discharging operation to the stencil attaching operation as described above. The circumferential wall 15 may be swollen to such an extent that it does not come in contact with the sheet drum, and the inside push roller (ink supplying roller 17) may be brought into contact with the inner peripheral surface of the circumferential wall 15. Therefore, even with a stencil printing machine wherein the circumferential wall 15 is swollen by the ink supplying roller 17 serving as the inside push roller, a stencil sheet M can be prevented from being wrinkled, as described above.

In the described embodiment, the ink supplying roller 17 (inside push roller) is moved in the state in which the stencil sheet M does not exist on the outer peripheral surface of the circumferential wall 15, and is brought into contact with the inner peripheral surface of the circumferential wall 15. According to this configuration, the configuration of the related stencil printing machine can be used to prevent the stencil sheet M from being wrinkled. However, another contact member moved so as to come in or out of contact with the inner peripheral surface of the circumferential wall 15 may be provided in place of the contact member of the ink supplying roller 17 (inside push roller) depending on the situation. As the new contact member, for example, a roller member, a member shaped like a plate piece, etc., is possible. As a move mechanism for moving the new contact member, for example, a configuration, wherein the new contact member is movably placed on the side plates 30 using the drive motor or rotation of the rotary cylindrical drum 16 as a drive source, may be considered.

What is claimed is:

1. A wrinkle preventing method for preventing a wrinkle on a stencil sheet, the method comprising the steps of:

providing a stencil printing machine which includes:

a rotary cylindrical drum rotatable about its own axis, the rotary cylindrical drum including an ink-permeable cylindrical circumferential wall having an outer peripheral surface around which a stencil sheet subjected to a stencil making process can be wound;

a contact member capable of contacting with an inner peripheral surface of the circumferential wall, the contact member being disposed in the rotary cylindrical drum; and a move mechanism capable of moving the contract member to a contact position at which the contact member is brought into contact with the inner peripheral surface of the circumferential wall or a distance position at which the contact member is spaced with a predetermined interval from the inner peripheral surface of the circumferential wall;

discharging the stencil sheet from the rotary cylindrical drum so that the rotary cylindrical drum is placed in a state in which the stencil sheet is not wound around the circumferential wall of the rotary cylindrical drum;

rotating the rotary cylindrical drum while placing the contact member at the contact position relative to an ink permeable portion of the circumferential wall;

placing the contact member at the distance position relative to the ink permeable portion of the circumferential wall; and winding, around the outer peripheral surface of the circumferential wall of the rotary cylindrical drum, a stencil sheet subjected to the stencil making process.

2. A stencil printing machine, comprising:

a rotary cylindrical drum rotatable about its own axis, the rotary cylindrical drum including an ink-permeable cylindrical circumferential wall having an outer peripheral surface around which a stencil sheet subjected to a stencil making process can be wound;

a contact member capable of contacting with an inner peripheral surface of the circumferential wall, the contact member being disposed in the rotary cylindrical drum; and a move mechanism capable of moving the contract member to a contact position at which the contact member is brought into contact with the inner peripheral surface of the circumferential wall or a distance position at which the contact member is spaced with a predetermined interval from the inner peripheral surface of the circumferential wall, wherein when the stencil sheet is not wound around the circumferential wall of the rotary cylindrical drum, the rotary cylindrical drum is rotated while the contact member is placed at the contact position relative to an ink permeable portion of the circumferential wall.

3. The stencil printing machine of claim 2, wherein the contact member includes an ink supplying roller which supplies ink to the inner peripheral surface of the circumferential wall.

* * * * *